US005983605A

United States Patent [19]

Parker et al.

[11] Patent Number: 5,983,605

[45] Date of Patent: Nov. 16, 1999

[54] MACHINE AND PROCESS FOR PACKING SMOKING ARTICLES

[75] Inventors: Michael Patrick Parker, Leighton Buzzard; Andrew Bray, Milton Keynes; Jonathan Charles Laughton, Bucks, all of United Kingdom

[73] Assignee: Rothmans International Services, London, United Kingdom

[21] Appl. No.: 09/131,832

[22] Filed: Aug. 10, 1998

[51] Int. Cl.[6] ..... B65B 11/58

[52] U.S. Cl. ..... 53/449; 53/148; 53/156; 53/170; 53/228; 53/444; 53/466

[58] Field of Search ..... 53/148, 149, 150, 53/151, 156, 157, 170, 173, 209, 228, 397, 449, 466, 580, 444

[56] References Cited

U.S. PATENT DOCUMENTS

| | | | |
|---|---|---|---|
| 1,452,692 | 4/1923 | Lazaga | 53/151 X |
| 1,487,019 | 3/1924 | Lopez | 53/151 X |
| 3,967,543 | 7/1976 | Seragnoli | 493/94 |
| 4,083,165 | 4/1978 | Maldina . | |
| 4,308,708 | 1/1982 | Focke | 53/174 X |
| 4,612,756 | 9/1986 | Focke et al. | 53/224 X |
| 4,938,005 | 7/1990 | Focke | 53/410 |
| 5,035,102 | 7/1991 | Tomahovits | 53/397 |
| 5,146,728 | 9/1992 | Knecht et al. | 53/234 X |
| 5,163,268 | 11/1992 | Vaccari et al. | 53/397 |
| 5,261,209 | 11/1993 | Focke et al. | 53/410 |
| 5,448,934 | 9/1995 | Boldrini et al. | 53/168 X |
| 5,657,609 | 8/1997 | Spada et al. | 53/176 X |

FOREIGN PATENT DOCUMENTS

| | | |
|---|---|---|
| 757250 | 9/1956 | United Kingdom . |
| 962991 | 7/1964 | United Kingdom . |
| 1543745 | 4/1979 | United Kingdom . |
| 2246109 | 1/1992 | United Kingdom . |
| 2258225 | 2/1993 | United Kingdom . |

*Primary Examiner*—Daniel B. Moon
*Attorney, Agent, or Firm*—Jones, Tullar & Cooper

[57] ABSTRACT

A machine and method for packaging smoking articles provides an essentially hermetic enclosure of a barrier material around a charge of such articles in an open (incomplete) frame, by driving on the articles themselves to push them through a temporary wall of the barrier material with the previous imposition on them of the open frame at a framing station. Preferably the driving is by means of an indexing conveyor which is stationary immediately before the collection of the charge from a hopper, during the imposition of the frame and immediately before pushing the frame and charge through the temporary wall.

17 Claims, 8 Drawing Sheets

MACHINE AND PROCESS FOR PACKING SMOKING ARTICLES

FIELD OF THE INVENTION

This invention relates to machines and processes for packaging smoking articles such as cigars, cigarillos and cigarettes, all of which articles will be referred to herein for simplicity as "cigarettes".

We are concerned here with a novel form of packaging as disclosed in our co-pending PCT Applications No. WO-A-9822367 and WO-A-9822368 in which cigarettes are enclosed within a sealed barrier layer, usually of metal foil/plastic laminate or of a metallized plastic. In particular the machine and process are able to produce the resealable packaging disclosed in '367.

BACKGROUND OF THE INVENTION

It is known from GB-A-962991 to overwrap filled packs of tobacco products by having an intermittent conveyor push them through a temporary wall of an overwrap material such as cellophane. Thereafter, side and end seals of the overwrap are formed as the assembly is held in a turntable. Other machines performing the same or similar operations on completed packs are seen in GB-A-757250, GB-A-1543745, GB-A-2246109, GB-A-2258225 and U.S. Pat. No. 4083165.

SUMMARY OF THE INVENTION

The present invention in one of its aspects also uses the technique of pushing an object to be wrapped through a temporary wall of wrapping material, but the purpose and context are different.

In the invention, a charge of cigarettes is assembled with an open frame of card or like material. An open frame is one which does not completely enclose the charge. Usually, at least one end of the charge and one major face of the charge are exposed. It is this assembly which is pushed through the temporary wall of wrapping material, which in this case is a barrier material. At least part of the barrier material will be in direct contact with cigarettes of the charge, once folding and sealing has been completed.

The result is usually a "semi-rigid" assembly as disclosed and claimed in our WO-A-9822368, and as such may be a complete finished pack (subject to possible conventional overwrapping) or part of a pack which has a conventional rigid outer container. Furthermore, for the purpose of a resealable package as seen in WO-A-9822367, the barrier material will have applied to it a cover having a permanently adhesive portion beyond each aperture-defining cut or line of weakness in the barrier material. Furthermore, at least one portion of that overlapping area may be folded or biased back so as to tend to project and form a readily-graspable tab for opening the resealable closure.

The sealed charge may then be inserted, possibly with other such charges, in a rigid container of the flip-top, shell and slide, Laubé or other type and may thereafter be overwrapped in a conventional manner.

In another aspect of the invention, the feed conveyor of a cigarette-packaging machine is an indexing conveyor (including in that term indexing pushers such as walking pushers), the indexing motion of the conveyor beginning at a time when a conveyor pusher is immediately behind an end of the cigarettes in the charge. Thus, the cigarette charge is progressively accelerated with the conveyor rather than being struck by the conveyor at speed, avoiding damage to and loosening of the tobacco rod of the cigarette. Normally, cigarettes will be driven in the collated charge with their filter ends foremost at all times so that without reversal it is the filter end of the charge which leads into the temporary wall of barrier material; however if it is desired that the conveyor (which in this case need not be an indexing conveyor) shall initially drive on the filter end of the cigarettes as it collects the charges from a delivery hopper, a turntable may be arranged before the charge meets the temporary wall so as to reverse the direction of progress of the cigarettes so that the filter end will meet the temporary wall; and in this case the assembly of the frame with the charge may take place on the turntable, especially if it is an indexing turntable.

In yet another aspect, assembly of a frame with a charge of cigarettes may occur by bringing an at least partially prefolded frame element down onto the collated charge of cigarettes during a time when it is stationary on an indexing conveyor; and the frame element will preferably include a tail flap to be folded down over the tobacco ends of the cigarettes, i.e. normally the trailing ends of the cigarettes, before, at latest, the completion of the sealing of the barrier material around the charge.

The invention provides also a machine for effecting the packaging of cigarettes including a supply station, a framing station for a charge of cigarettes from the supply station, where a frame element is to be placed at least partially around the charge, a pick-up station, with means for feeding an impermeable flexible web to the pick-up station to extend through the path of the framed charge, means for pushing the charge through the web at the pick-up station and for taking the charge and barrier web to longitudinal and end seal stations whereby the web forms a sealed enclosure around the charge. In yet another aspect of the invention, a cigarette-packaging machine further includes a web feed line in which a web is given an aperture-defining cut or line of weakening and which has a subsequent station where a flexible sealing layer is applied over the aperture so defined, the layer preferably having permanently adhesive marginal portions overlapping over the edges of the aperture-defining cut or line, the web and cover being delivered to the pick-up-up station with the cover on the side remote from the direction of approach of the cigarette charge and with the aperture aligned with the leading face of the charge, which will usually be the filter end of a charge.

A conveyor taking the charge from a supply station of a cigarette-packaging machine to a pick-up station where it encounters a temporary wall of barrier material may be an indexing conveyor and it is particularly desirable that it is an indexing conveyor when a hopper at the supply station presents the cigarettes with a tobacco end to be abutted by pushers on the conveyor. In any case, the position of supply and the indexing of the conveyor can be be preferably coordinated so that an arrested position of the conveyor pushers is immediately adjacent the tobacco ends of the charge, and the charge and pushers therefore accelerate smoothly together when the latter moves. Furthermore, when an indexing conveyor is provided the frame may be fitted to the charge during a pause in the indexing movement and/or the charge is stopped with its leading end just clear of the temporary wall formed by the barrier layer so that, once again, the charge and wall will accelerate together upon resumed movement of the conveyor. Likewise, folding in of end falps of an open frame may also occur while an indexing conveyor is stationary.

In an alternative machine a conveyor bringing a charge from the supply may abut the filter end of the cigarettes and in this case the machine will preferably include means for reversing the cigarettes before they reach the pick-up station so that the filter end is at the leading end of the charge at that time; this conveyor need not be an indexing conveyor and could be a reciprocating pusher. The reversing means may include a turntable and if this is an indexing turntable pauses in the indexing motions of the turntable may be used for the purpose of fitting the frame to the charge.

DESCRIPTION OF THE DRAWINGS

In the accompanying drawings:

In FIG. 1, a conveyor 1 has pushers which draw from a supply station at the bottom of a supply hopper (not shown) a charge 2 of cigarettes, as the pushers pass through the base of that hopper. The conveyor runs in a trough so that the cigarettes maintain a collated relationship while being transferred by it.

Especially if the cigarettes are taken from the hopper by action between a pusher of the conveyor and the tobacco end of the cigarette it is preferred that the conveyor 1 will be an indexing conveyor, with the supply station, and other stations to be described, coordinated with the indexing of the conveyor such that the pushers are stationary when they are immediately behind the ends of the cigarettes in the hopper so that the charge of cigarettes is progressively accelerated together with the conveyor rather than being struck by it at speed as would be the case with a continuously moving conveyor. This diminishes the shock experienced by the tobacco end of the cigarettes and consequently the tobacco loss from and distortion of that end. Also, the charge of cigarettes is stationary at the final stages of an assembly of a frame around them and as its leading end almost touches a temporary wall of flexible barrier material which is to form a wrapping; in the latter case the barrier material is progressively accelerated with the charge rather than being impacted with it at speed.

In more detail, the conveyor 1 brings the charges 2 to a framing station 3 at which precut cardboard blanks for an inner frame are fed along transfer rails 4 to be placed respectively over charges at position 2' with folded side panels extending downwardly at each side of the charge. Various conformations of frame blanks are shown in our copending PCT applications: all have in common that they are open frames incapable of being by themselves formed into a coherent container. For the most part they have only one major face, two side panels, and only one end flap, which may be only partial and may be made up of extensions of the side panels.

Before the station 3 there is a conventional "missing cigarette" detector which causes ejection of any defective charge.

Figure 3:
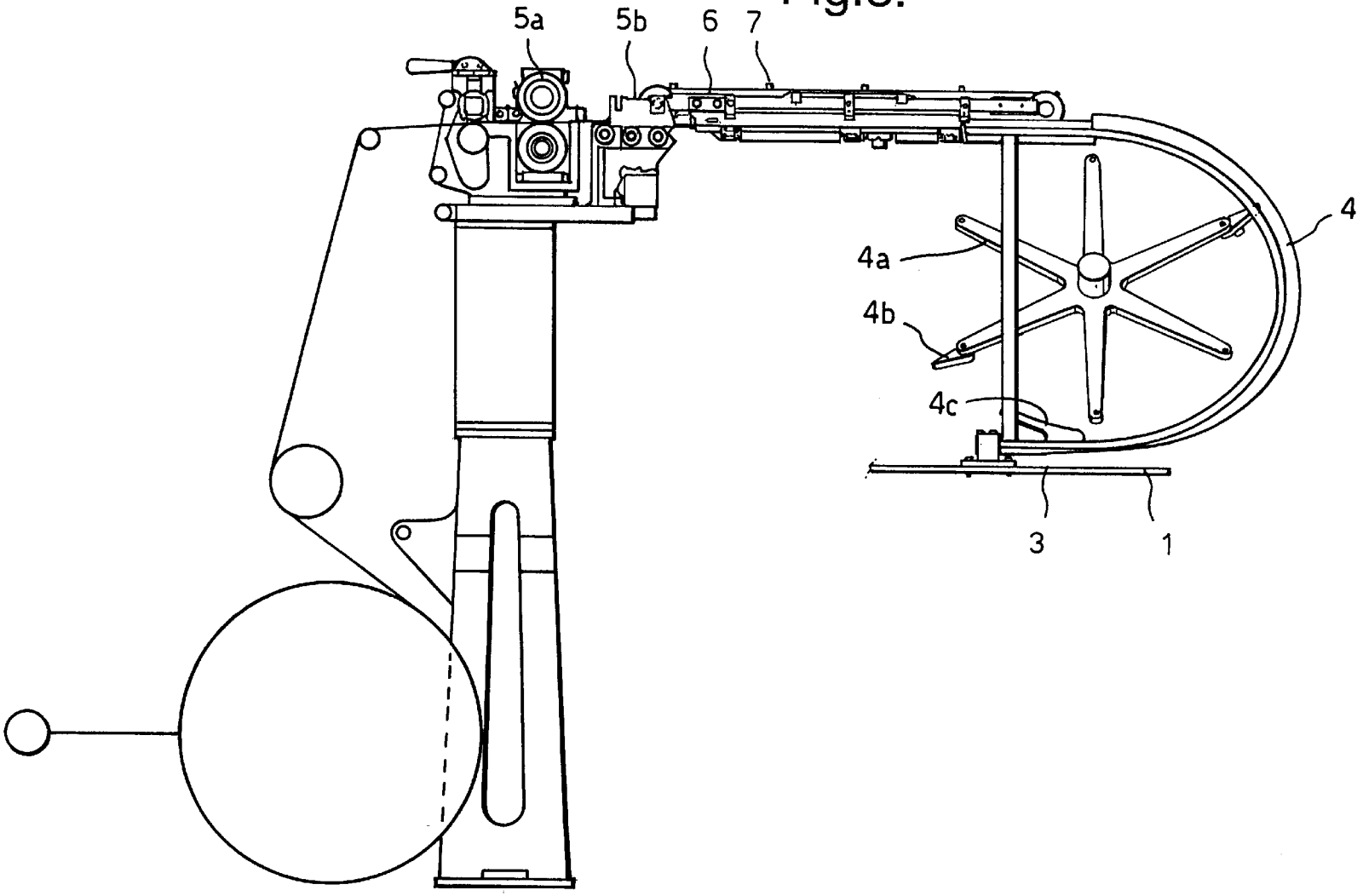
FIG. 3 is a side view of part of the first portion.

Frame blanks as seen in FIGS. 13 and 14 of WO-A-9822368 are cut at 5*a* (FIG. 3) from a web of card and accelerated by feed rollers through a pair of folders 5*b* at which their side panels are folded upwardly and into a guide below a conveyor 6 having pushers 7 which descend behind the respective blanks to bring them in spaced relationship to the rails 4. At the centre of curvature of the rails 4 is a sprocket wheel 4*a*, ends 4*b* of the spokes of which (only two are shown) engage behind the blanks as they leave the conveyor 6. The ends 4*b* of the spokes are pivotable and are retracted by cam 4*c* engaging a follower 4*d*, so that as respective blanks reach the station 3 the spokes do not interfere with the conveyor 1 or charges 2, 2' on it.

Figure 4:
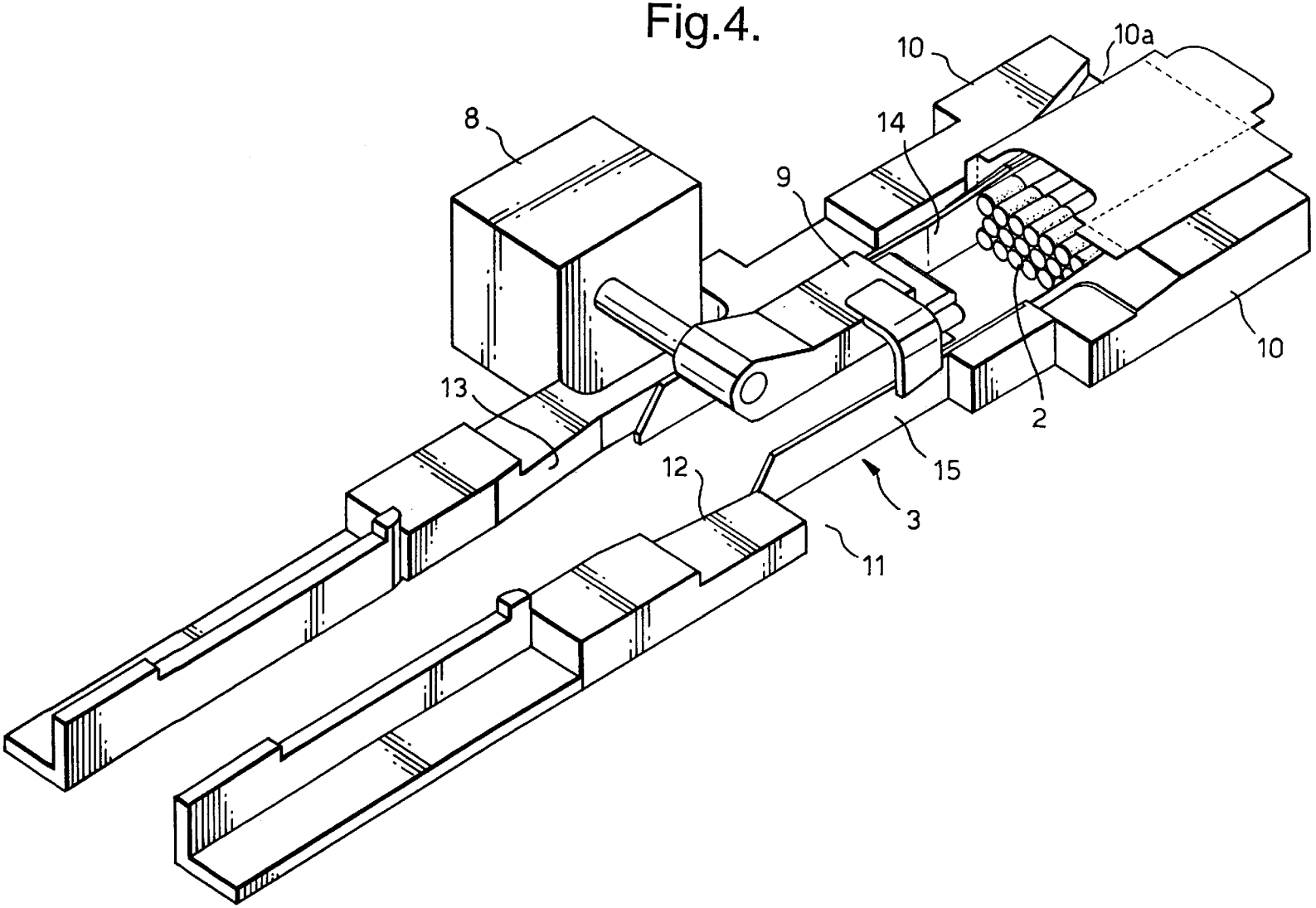
FIGS. 4 and 5 are perspective views of part of the first portion at different stages of operation.

As the blanks are inverted as they travel along around the track 4 the side panels become downward projections below the main panels; the conveyor 6 is offset from the vertical from the conveyor 1 to allow access for the barrier layer (to be described). One side of the blanks has to traverse the line of the conveyor 1 and of the charges 2, 2'. To allow this the appropriate side panel is unfolded by one of the tracks 4. The situation as the charge and frame blank approach the station 3 is seen in FIG. 4. The folded side wall of the blank enters into a tapering guide 10*a* between the main wall 10 of the trough and a guide blade 14. The opened side panel lies over the other main wall 10. Once the retracted end 4*b* of the sprocket wheel 4*a* has cleared the blank now at position 3, a drive 8 brings down a dabber plate 9 which at the same time presses the main panel and the folded side panel of the blank down onto and beside one side of the charge, and refolds downwardly the other side panel to the other side of the charge outside a second guide blade 15. This situation is seen in FIG. 5.

Figure 5:
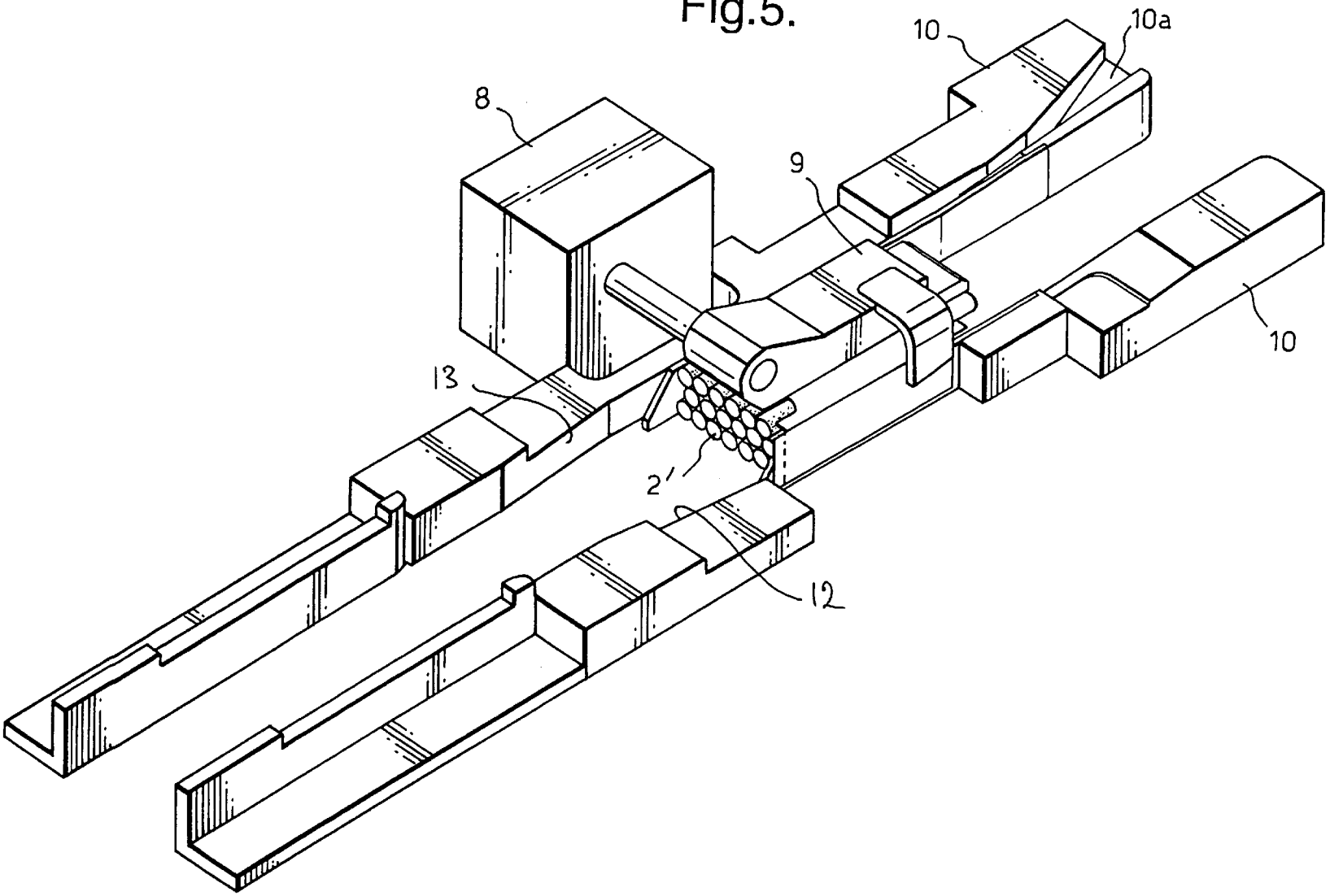
Figure 6:
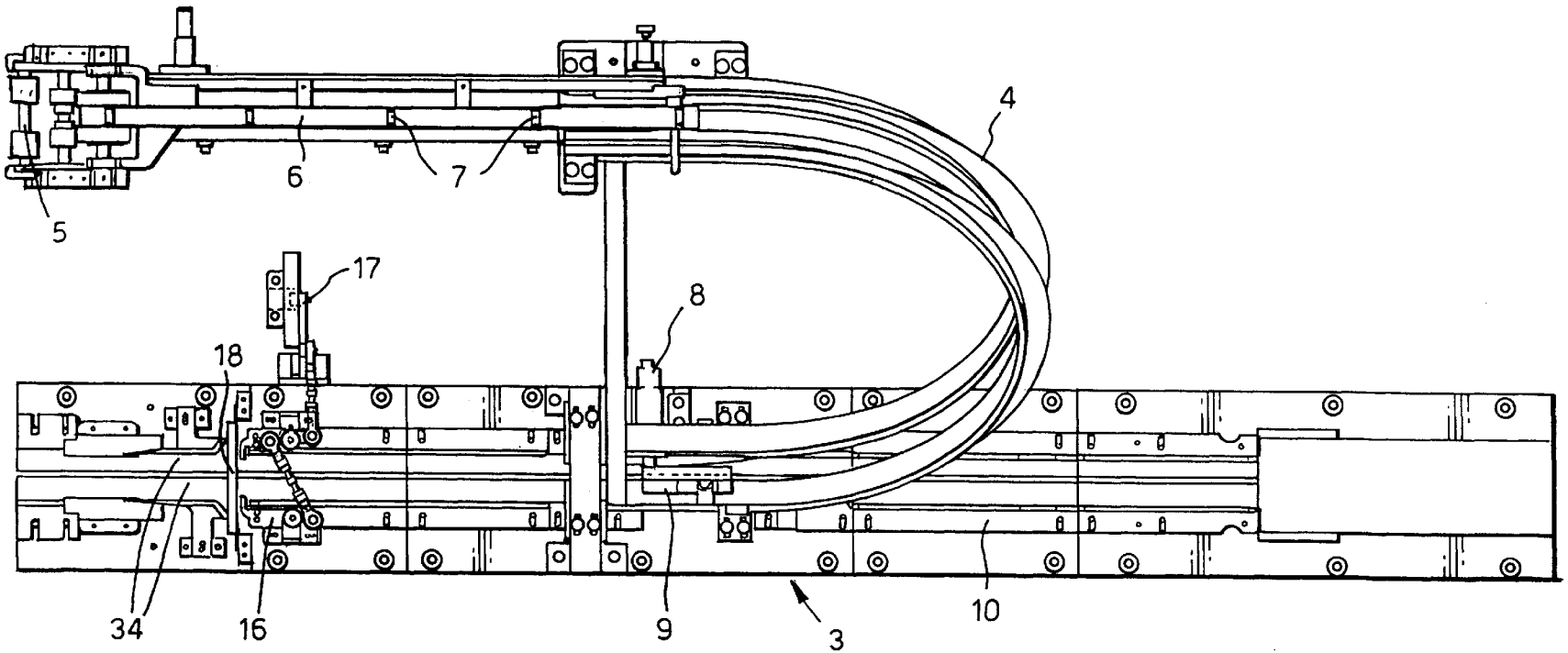
FIG. 6 is a plan view of that part.

As is best seen in FIG. 5, one wall of the trough has a missing portion 11, through which gap the side panel folds down.

Figure 7:
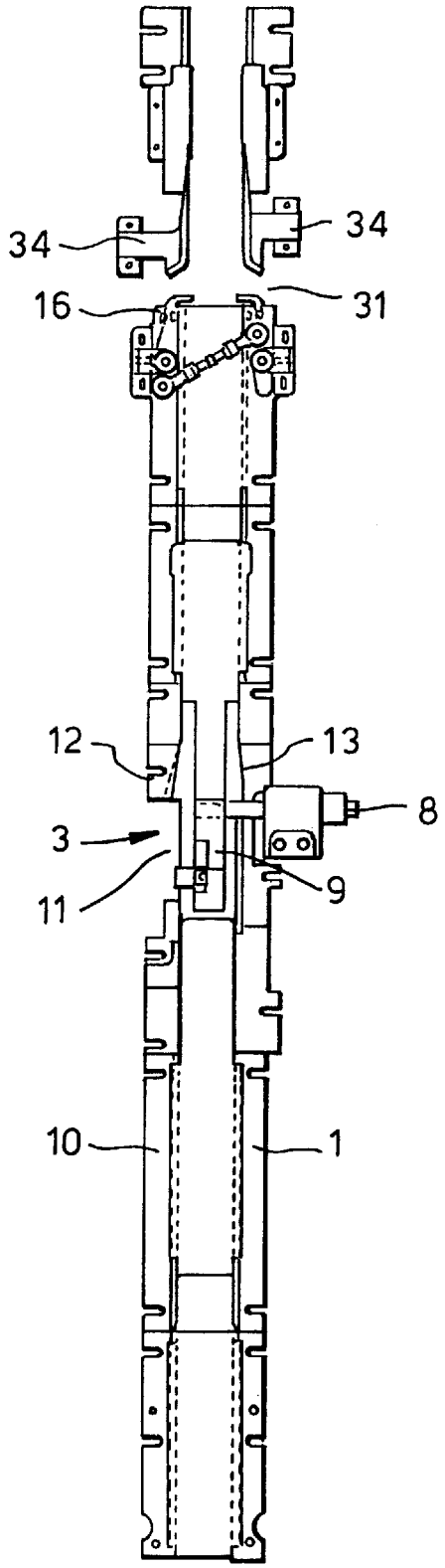
FIG. 7 is a plan view of that part with elements removed for clarity.

As the charge 2', now openly framed by the folded blank, is moved off by the conveyor 1, the side panels enter convergences 12, 13 in the walls of the trough—see also FIG. 7. The convergence 12 is flared downwardly at its mouth to allow for any tendency of the refolded side wall to spring out. These side panels are thereby kept compact with the charge.

The framed charge is then brought at 2" to a pick-up station where during the progression of the conveyor it is driven through a temporary wall formed by a barrier material 18. While it is stationary before being so driven, tucker arms 16 are actuated by cam drive 17 to fold inwardly any forward end flaps on the side panels of the frame.

The barrier material such as a metal foil/plastic laminate or paper/plastic laminate or a metallised plastics web derives from a reel 19 or 20 (only one is used at a time) being taken through guide rollers 21, 22 to a cutting station 23 where cuts, lines of weakening or the like may be formed repetitiously in the web to define apertures etc., as appropriate, in the wrapping which the barrier material will form.

The web cut as appropriate but still continuous, then passes to a labelling station 24 where self-adhesive cover sheets on a release web are fed from reel 25 through a head 26 at the station 24 with the release web then being taken up on reel 27.

When as is preferred the barrier layer is going to be a resealable one as described in application WO-A-9822367 the label applied will be one which has a permanently sticky portion projecting around the openable edges of an aperture defined by the cuts or lines of weakening formed at the station 23. However, additional or different labels may be applied or, possibly, none at all.

The labelled web then travels over further idlers 28 to drive roller pairs 29 which feed it via a slit between guides 30 through a gap 31 in the conveyor bed to be brushed downwardly below the conveyor by a rotating brush 32, so that despite having a free end below the level of the conveyor the appropriate length of material is held as a barrier wall through which the framed charge of cigarettes is caused to move by the conveyor. As it does so the barrier material is cut to length by knife 33. As the charge progresses it will sweep the barrier material under plough 34 backwardly from its leading edge above and below what are now its upper and lower surfaces, and the position of any aperture and cover layer will be adjusted so that there is alignment with the inner frame and the filter ends of the charge of cigarettes. In the completed package therefore the aperture will offer access to those filter ends and to the recess normally provided in the inner frame for the convenience of the user.

During the making of the label, at the labelling stage or later a portion of the cover not having permanent adhesive may be bent back so that in the completed package it lies at an angle to the remainder of the label and readily offers a tab or handle for the user to hold when opening the barrier layer of the package.

Figure 1:
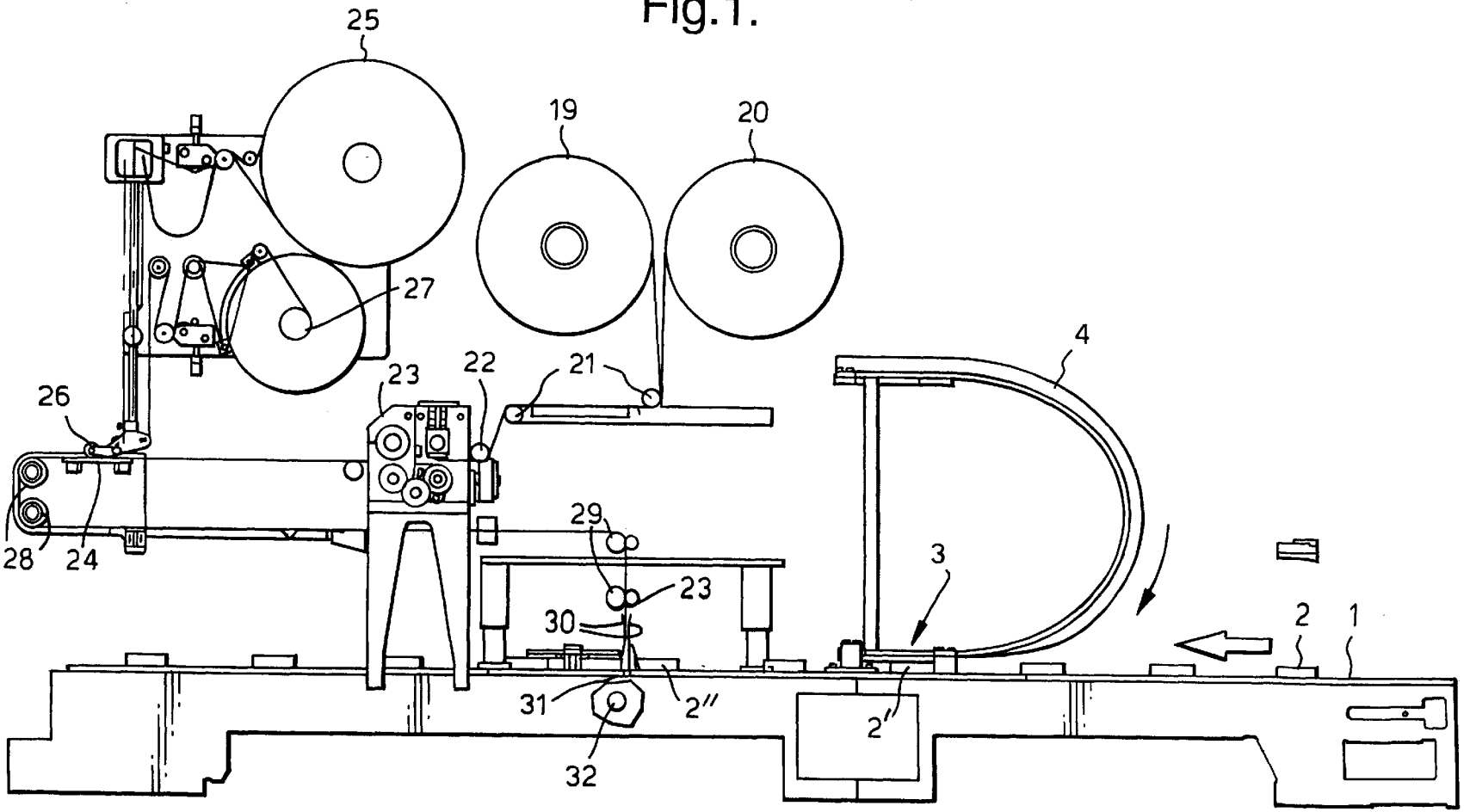
FIG. 1 is a side view of a first portion of machine.
Figure 2:
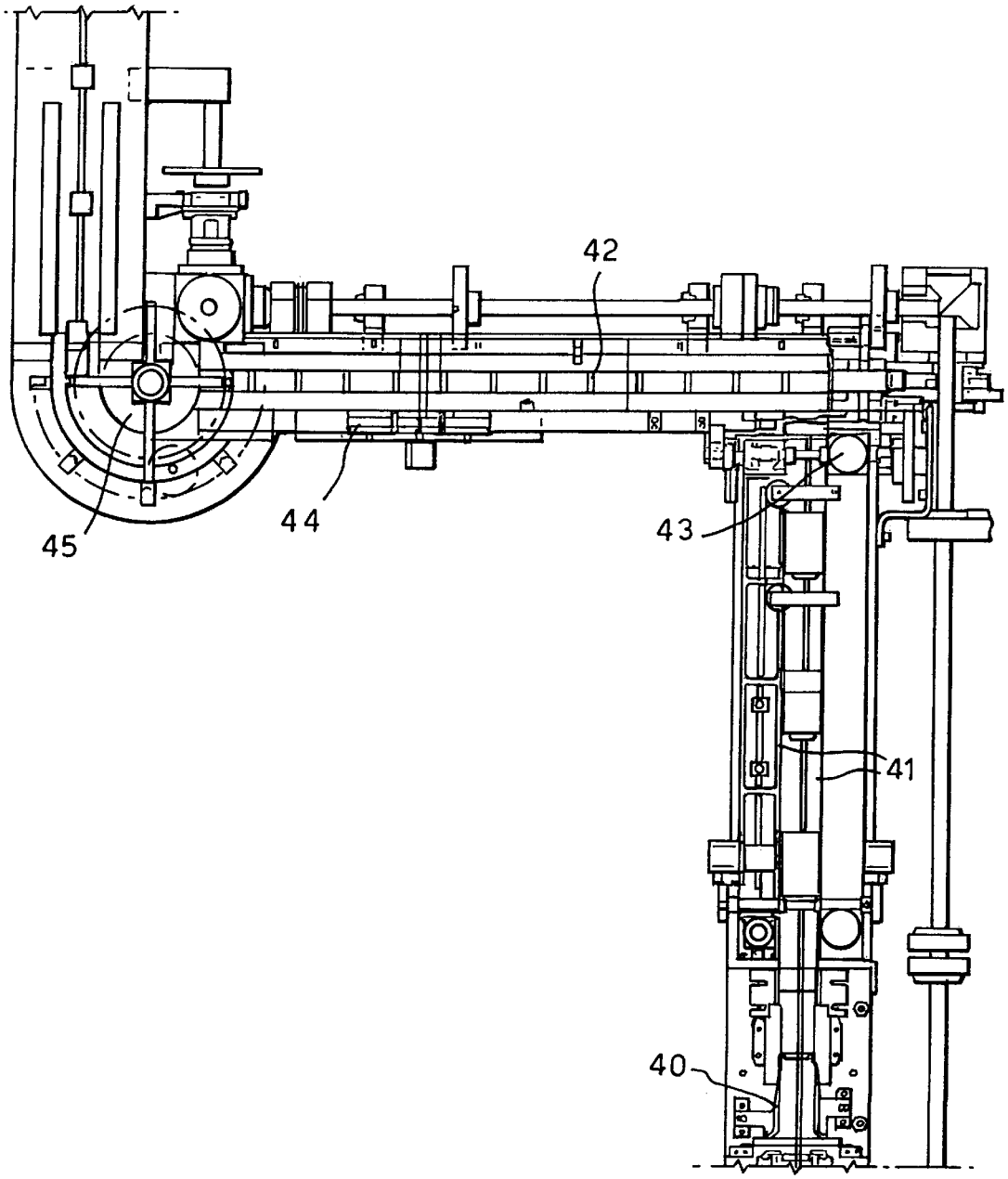
FIG. 2 is a plan view of a second portion.

The framed charges with the barrier material extending to each side and behind them then progress to the part of the machine shown in FIG. 2 where they first pass through converters 40 where flat side seams are formed which are then heat sealed by progress of the charges between heated faces such as those of sliders, tractors or conveyor bands 41. The charges now enclosed at five of the six sides of the pack are then transferred to an indexing conveyor 42 having full or partial pockets, the latter being shown in FIG. 2. At the entry end of the conveyor any unfolded bottom flap of the frame is folded down and held while in a reciprocating folder generally indicated at 43 which makes one end fold. The conveyor then indexes and a second end fold is made. As the charges progress, ploughs form long folds these long folds being finally heat sealed either separately or in one operation at the bottom end of the charge by heated faces such as reciprocating slide or tractor heaters 44 in a series of stations.

The fully sealed charges may now pass to a roundabout 45 and out to further conventional packaging and optionally overwrapping.

There has thus been provided both a means and process by which a completely sealed charge of cigarettes is formed, which if the barrier is moisture-proof will be as far as practically possible a hermetic seal.

Of course if the smoking articles are not filtered it is a matter of no importance in which direction they progress in the initial stages or which of their ends meets the temporary wall formed by the barrier material at the pick-up station 2". However most cigarettes nowadays are filter cigarettes and in that case it is preferably the filter end which first meets the wall.

Figure 8:
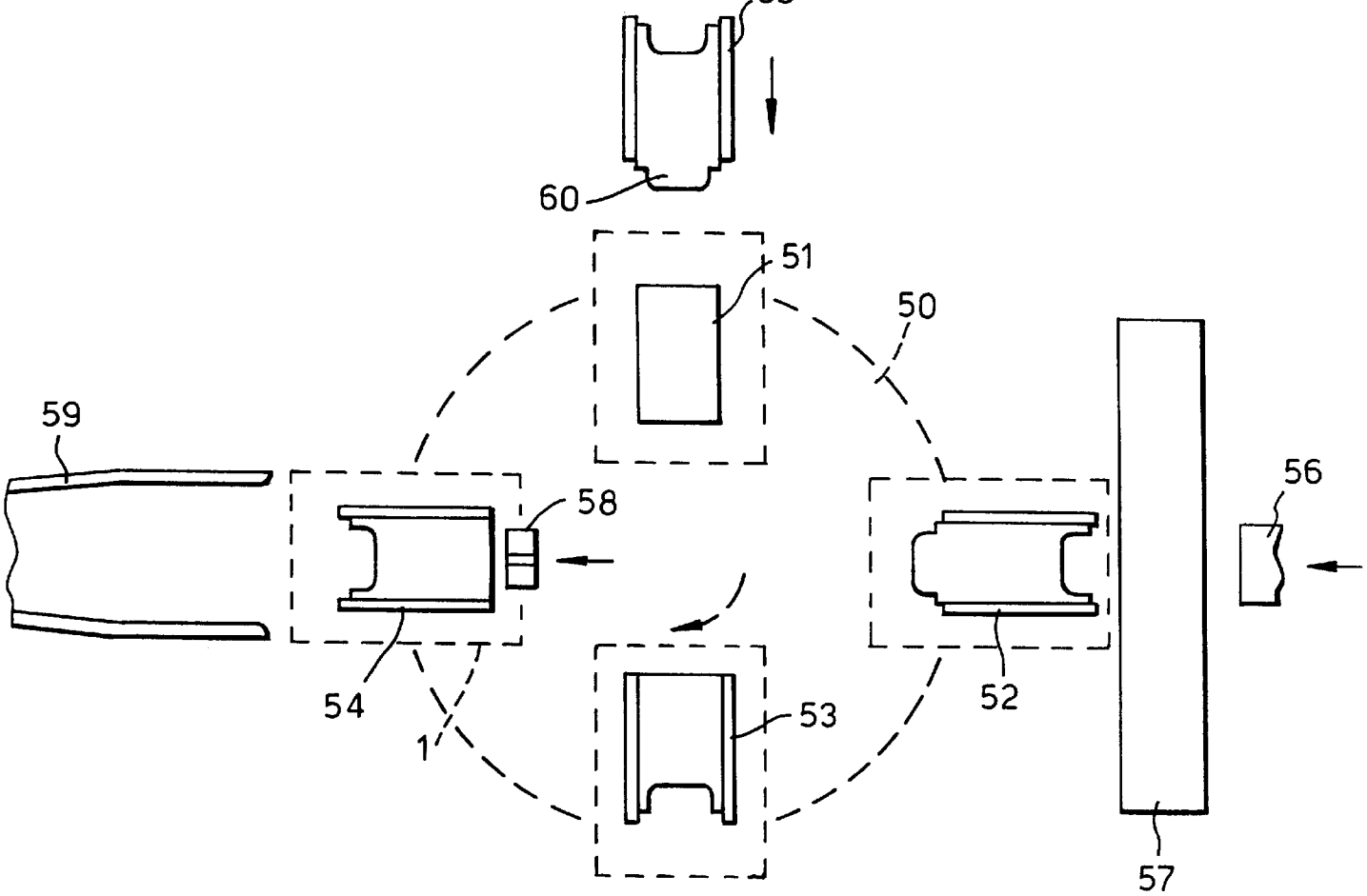
FIG. 8 is a plan view of a detail of a modification.

If it is desired to pick up the cigarettes from the supply source by driving the filter end, which avoids any possible problems of shaking loose of tobacco material from the tobacco rod or distortion of that rod, but nevertheless the filter end needs to meet the temporary wall first at pick-up station 2", a turntable 50 can be interposed before that station as seen in FIG. 8.

The turntable bears four slotted carriers at positions 51–54. At position 51 a frame blank 55 is brought forward and its side panels folded down within the side walls of the carrier. The turntable indexes to position 52 where a conveyor or reciprocating pusher 56 inserts a charge of cigarettes from hopper 57. The turntable indexes further to positions 53 and 54, at the latter of which pusher 58 from conveyor 1 engages the charge and frame together, through the slot of the carrier, and delivers it down trough 59 towards the pick-up station 2". Base panel 60 of the blank is folded down either before it is placed on the turntable, or while it is on it, and is in position to protect the ends of the charge of cigarettes from direct engagement by pushers 58.

We claim:

1. A process for packaging cigarettes which consists of collating a charge of such cigarettes, collecting the collated charge by driving on the cigarettes to a framing station, placing an open frame around that charge at the framing station while leaving the charge partially exposed, passing the charge and frame through a temporary wall formed by a flexible barrier material so as to sweep material of that barrier material rearwardly along two faces of the charge, and folding and sealing the barrier material to form an enclosure around the charge and frame.

2. A process according to claim 1 in which the collated charge of cigarette is collected by a conveyor which drives on the ends of cigarettes of the charge, the conveyor is an indexing conveyor and an indexing motion of the conveyor begins at a time when a conveyor pusher is immediately behind the tobacco end of the cigarette.

3. A process according to claim 2 wherein the conveyor drives on the tobacco ends of filter cigarettes of the charge.

4. A process according to claim 2 wherein the collated charge is picked up by the conveyor by pushing on the filter ends of filter cigarettes, the charge being reversed before being passed through the temporary wall.

5. A process according to claim 2 in which cigarettes are driven in the collated charge with their filter ends foremost at all times so that without reversal it is the filter end of the charge which leads into the temporary wall of barrier material.

6. A process according to claim 1 wherein the assembly of the frame with the charge occurs by bringing at least partially prefolded frame elements down onto the collated charge of cigarettes during a time when they are stationary on an indexing conveyor.

7. A process according to claim 6 wherein the frame element includes a tail flap to be folded over the trailing ends of the charge, before the completion of the sealing of the barrier material around the charge.

8. A process according to claim 1 wherein the flexible barrier material includes an aperture-defining area, with a flexible sealing layer applied over that area and adhesively overlapping the edges of the area, the aperture-defining area being positioned in the temporary wall to be in register with a leading end of the charge of cigarettes as it meets that wall.

9. A process according to claim 6 wherein the flexible barrier material includes an aperture-defining area, with a flexible sealing layer applied over that area and adhesively overlapping the edges of the area, the aperture-defining area being positioned in the temporary wall to be in register with a leading end of the charge of cigarettes as it meets that wall.

10. A machine for packaging cigarettes including a supply station means for driving on the cigarettes to forward them from the supply station to a framing station where a frame element is placed partially around the charge, a pick-up station, with means for feeding an impermeable flexible web to the pick-up station to extend through the path of the framed charge, means for pushing the charge through the web at the pick-up station and for taking the charge and barrier web to longitudinal and end seal stations whereby the web forms a sealed enclosure around the charge and frame.

11. A machine according to claim 10 which further includes a web feed line in which a web is given an aperture-defining cut or line of weakening has a subsequent station where a flexible sealing layer is applied over the aperture area so defined, the layer having permanently adhesive marginal portions overlapping over the edges of the aperture area, the web and cover being delivered to the pick-up station with the layer on the side remote from the direction of approach of the cigarette charge and with the aperture area in register with the leading face of the charge.

12. A machine according to claim 10 wherein an indexing conveyor takes the charge from the supply station to the pick-up station.

13. A machine according to claim 12 wherein a hopper at the supply station presents the cigarettes with a tobacco end to be abutted by pushers on the conveyor.

14. A machine according to claim 12 wherein a hopper at the supply station presents the cigarettes with a filter end to be abutted by pushers on the conveyor and the machine includes means for reversing the charge before the pick-up station.

15. A machine according to claim 10 wherein feed means for bringing the frame element to the framing station include a transfer rail converging on the cigarettes at the framing station and for presenting the blank to the cigarettes.

16. A machine according to claim 15 wherein the blank has one side panel orthogonal to its main face at the time of presentation, and means conforming the other side panel to a side of the charge.

17. A machine according to claim 16 including means subsequent to the framing station for folding-in an end flap of the blank to conform to an end of the charge.

* * * * *

UNITED STATES PATENT AND TRADEMARK OFFICE

CERTIFICATE OF CORRECTION

PATENT NO. : 5,983,605

DATED : November 16, 1999

INVENTOR(S) : Parker et al.

It is certified that error appears in the above-indentified patent and that said Letters Patent is hereby corrected as shown below:

On the left column of the cover page, after the filing date, the following should be inserted:

[30] Foreign Application Priority Data

August 8, 1997 [UK] United Kingdom....9716899.1

Signed and Sealed this

Third Day of April, 2001

*Attest:*

Nicholas P. Godici

NICHOLAS P. GODICI

*Attesting Officer*

*Acting Director of the United States Patent and Trademark Office*